US007626368B2

(12) United States Patent
Novak

(10) Patent No.: US 7,626,368 B2
(45) Date of Patent: Dec. 1, 2009

(54) METHOD AND APPARATUS FOR PROVIDING A REGULATED VOLTAGE AT A VOLTAGE OUTPUT

(75) Inventor: Heinz Novak, Graz (AT)

(73) Assignee: Infineon Technologies AG, Munich (DE)

( * ) Notice: Subject to any disclaimer, the term of this patent is extended or adjusted under 35 U.S.C. 154(b) by 411 days.

(21) Appl. No.: 11/734,029

(22) Filed: Apr. 11, 2007

(65) Prior Publication Data

US 2007/0236279 A1 Oct. 11, 2007

(30) Foreign Application Priority Data

Apr. 11, 2006 (DE) ..... 10 2006 017 048

(51) Int. Cl.
*G05F 1/565* (2006.01)

(52) U.S. Cl. ..... 323/275; 323/315

(58) Field of Classification Search ..... 323/312–315, 323/274, 275, 280, 285; 307/43, 75; 327/540
See application file for complete search history.

(56) References Cited

U.S. PATENT DOCUMENTS

| | | | | |
|---|---|---|---|---|
| 6,515,880 | B1 * | 2/2003 | Evans et al. | 363/49 |
| 7,190,150 | B2 * | 3/2007 | Chen et al. | 323/222 |
| 7,212,067 | B2 * | 5/2007 | Pasternak | 327/541 |
| 2006/0001410 | A1 * | 1/2006 | Ishikawa et al. | 323/282 |
| 2007/0120423 | A1 * | 5/2007 | Lopata | 307/43 |

* cited by examiner

*Primary Examiner*—Jessica Han
(74) *Attorney, Agent, or Firm*—Eschweiler & Associates, LLC

(57) ABSTRACT

An apparatus for supplying a glitch-free, regulated voltage at a voltage output includes a main transistor, which is connected between an intermediate potential and the voltage output, a bypass transistor, which is connected between a supply potential and the voltage output, the intermediate potential being lower than the supply potential and the intermediate potential and the supply potential being derived from a common voltage source, a regulation circuit for applying a main control potential to the main transistor, in order to regulate a voltage at the voltage output to a desired voltage, and a control circuit for generating a bypass control potential as a function of the supply potential and the main control potential, and to apply the bypass control potential to the bypass transistor.

19 Claims, 2 Drawing Sheets

METHOD AND APPARATUS FOR PROVIDING A REGULATED VOLTAGE AT A VOLTAGE OUTPUT

CROSS-REFERENCE TO RELATED APPLICATIONS

This application claims priority from German Patent Application No. 10 2006 017 048.2, which was filed on Apr. 11, 2006, and is incorporated herein by reference in its entirety.

TECHNICAL FIELD

This invention relates to apparatuses and methods for providing a regulated voltage at a voltage output, such as they can be used e.g. in the automotive technology.

BACKGROUND

Various stable voltages are generally needed in electronic circuits. In order to be able to supply these various voltage levels, there are used, among others, voltage regulators. Voltage regulators, which operate in systems with high battery voltage VBAT and a DC/DC buck-converter, are normally supplied with an output voltage VDCDC of the buck-converter, in order to keep power loss low in the voltage regulator. Such voltage regulators are used e.g. in motor vehicles, in order to supply a regulated supply voltage to electric control devices such as e.g. microcontrollers and other critical components. The requirements regarding the output voltage of the voltage regulator are high.

For supplying a voltage regulator in a motor vehicle the generally higher battery voltage VBAT, which in a motor vehicle can be overlaid by high positive and negative parasitic voltages, is converted by the buck-converter into a comparatively lower intermediate potential VDCDC. The power dissipation in the voltage regulator is thus maintained low. In order to regulate the output voltage of the voltage regulator, e.g. a regulation transistor incorporated into a regulation circuit can suitably be connected between the intermediate potential VDCDC and the output voltage of the voltage regulator, which regulates the voltage drop between VDCDC and the output by means of an applied control potential. If the battery voltage VBAT drops, the output voltage of the buck-converter VDCDC at first remains constant and starts to drop according to VBAT as soon as VBAT drops to a saturation voltage above the set value of VDCDC. In order to allow the voltage regulator to operate even when the battery voltage drops further and, hence, at intermediate voltages VDCDC set to a lower value dropping to the same extent, a bypass transistor can in this case be connected to the regulation transistor of the voltage regulator.

Abrupt connecting, however, causes unwanted voltage peaks or voltage dips (so-called glitches) at the output of the voltage regulator. These glitches can e.g. cause short-duration false assertions in logic circuits supplied with the regulated voltage and are thus a substantial problem for the development of modern electronic circuits. E.g. in the field of the motor vehicles, glitches are therefore unacceptable, since they could cause failures of the control electronics.

SUMMARY

According to an embodiment, an apparatus for providing a regulated voltage at a voltage output may have a main transistor, which is connected between an intermediate potential and the voltage output; a bypass transistor, which is connected between a supply potential and the voltage output, the intermediate potential being lower than the supply potential and the intermediate potential and the supply potential being derived from a common voltage source; a regulation circuit for applying a main control potential to the main transistor, in order to regulate a voltage at the voltage output to a desired voltage; and a control circuit for generating a bypass control potential as a function of the supply potential and the main control potential, and for applying the bypass control potential to the bypass transistor.

BRIEF DESCRIPTION OF THE DRAWINGS

Different embodiments will be detailed subsequently referring to the appended drawings, in which.

DETAILED DESCRIPTION

Figure 1:
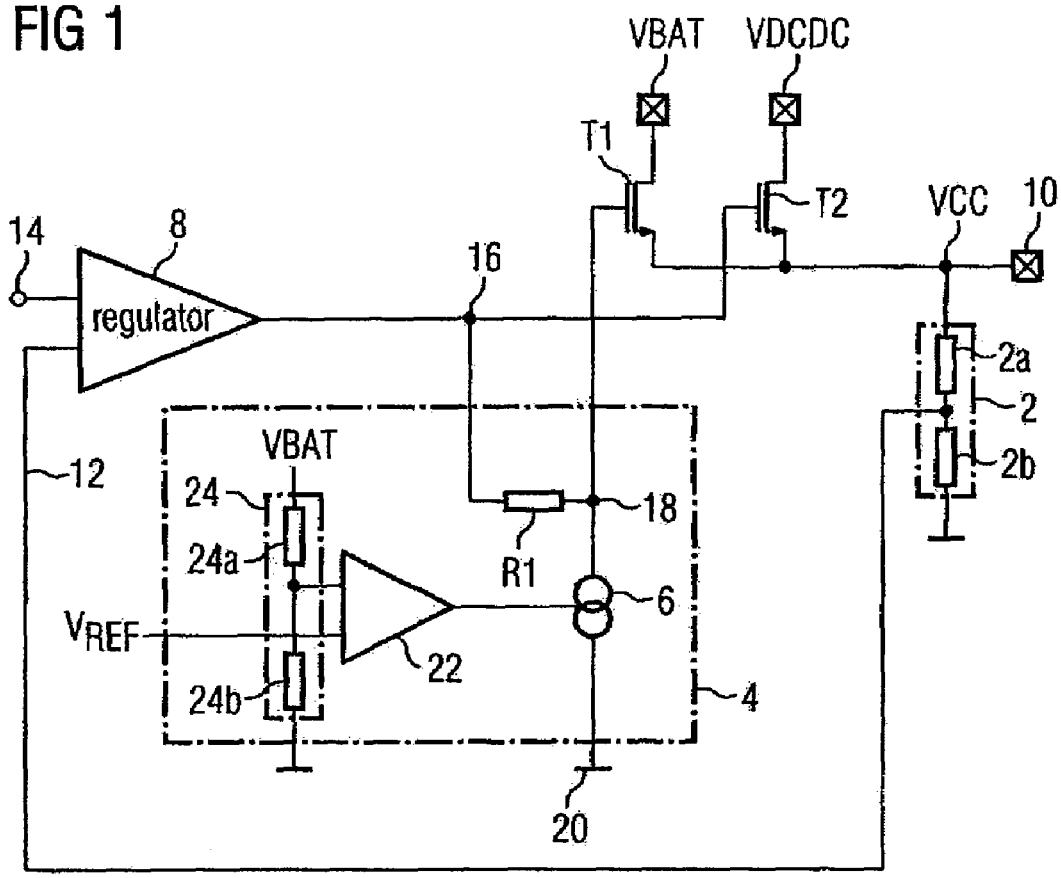
FIG. 1 is a principle circuit diagram of a voltage regulation circuit according to an embodiment.

According to another embodiment, a method for providing a regulated voltage at a voltage output by means of a main transistor, which is connected between an intermediate potential and the voltage output, and a bypass transistor, which is connected between a supply potential and the voltage output, the intermediate potential being lower than the supply potential and the intermediate potential and the supply potential being derived from a common voltage source, may have the steps of applying a main control potential to the main transistor, in order to regulate a voltage at the voltage output to a desired voltage; generating a bypass control potential as a function of the supply potential and the main control potential; and applying the bypass control potential to the bypass transistor.

According to another embodiment, a computer program may have program code for performing, when the computer program is executed on a computer and/or a microcontroller, a method for providing a regulated voltage at a voltage output by means of a main transistor, which is connected between an intermediate potential and the voltage output, and a bypass transistor, which is connected between a supply potential and the voltage output, the intermediate potential being lower than the supply potential and the intermediate potential and the supply potential being derived from a common voltage source, wherein the method may have the steps of applying a main control potential to the main transistor, in order to regulate a voltage at the voltage output to a desired voltage; generating a bypass control potential as a function of the supply potential and the main control potential; and applying the bypass control potential to the bypass transistor.

According to an embodiment, a continuous connection of a bypass transistor, thus reducing the extent of glitches, can be achieved when applying to the bypass transistor a bypass control potential, which depends on the supply potential and the main control potential with which the main transistor is controlled for regulation.

According to an embodiment, the bypass transistor is, in the case of the voltage regulator, continuously connected to the voltage control circuit according to the amount of the supply potential for regulating the output voltage of the voltage regulator. At a sufficiently high supply potential, only the main transistor is operating, which regulates the intermediate potential derived from the supply potential. If the supply potential drops, the bypass transistor is connected continuously. The connection occurs in that the control potential of the bypass transistor is continuously brought to the control potential of the main transistor, i.e. with a continuous dependence on both the supply potential and the main control potential, such as e.g. by continuously reducing a current flow through a resistive element or impedance element, which is connected between the control terminals of the transistors, with dropping supply potential.

This embodiment has the advantage that no or at least less voltage dips or spikes can be seen at the voltage output when connecting the bypass transistor, and that an undisturbed or less disturbed output voltage is thus present. Thus, e.g. a faulty control of microcontrollers, which can have fatal consequences under certain circumstances, can be avoided or a probability of occurrence for this can be reduced.

A further advantage is that there is no regulation circuit of its own for the bypass transistor, which has to be tuned according to the control circuit of the main transistor. There is rather only one regulation circuit for the voltage regulation, and both main and bypass transistors operate due to the dependence of the bypass potential on the main control potential within the same regulation circuit, whereby no additional stability problems arise in the circuit due to the bypass transistor.

FIG. 1 shows a voltage regulator with a bypass transistor T1 that can be connected continuously according to an embodiment. In the following description, it is assumed that the transistors shown in FIG. 1 are NMOS transistors. Other implementations are of course also possible, in particular as PMOS or bipolar transistors.

The regulator of FIG. 1 includes, besides the bypass transistor T1, a main transistor T2, a voltage divider 2, a connecting circuit 4 with a controllable current source 6 and a regulator 8, the transistor T2 forming together with the voltage divider 2 and the regulator 8 a regulation loop for regulating a voltage at a voltage output 10 of the circuit of FIG. 1 to a desired voltage VCC, to which the transistor T1 is continuously connected, as described below.

The control terminal of the main transistor T2, for which, like for the bypass transistor T1, it is assumed that it is an NMOS transistor, although other embodiments are possible as well, is connected to an output of the regulator 8, the first input 12 of which is connected, in turn, to a central tap of the voltage divider 2, while at a second input 14 of the same is present a comparison voltage. The main transistor T2 is connected in parallel with the bypass transistor T1 in that its source terminal as well as the source terminal of the bypass transistor T1 are connected to the voltage output 10. The control terminal or its gate is, however, not connected directly to the output of the regulator 8, but via a resistor R1 of the connecting circuit 4. At the drain terminal of the bypass transistor T1 is present a supply potential, such as e.g. a battery potential, VBAT, while at the drain terminal of the main transistor T2 is present an intermediate potential VDCDC, which is derived from the supply potential VBAT or a voltage source, such as e.g. a battery or a generator, from which both VBAT and VDCDC are derived, so that VDCDC is lower than VBAT, such as e.g. by means of a buck-converter, not shown.

The voltage divider 2 includes two resistors 2*a* and 2*b* connected between the output 10 and a reference potential, such as e.g. ground, the output potential VCC with a predetermined division ratio being fed back, from a connecting node between the resistors, to the first input 12 of the regulator 8. The reference potential at the second input 14 of the regulator 8 is supplied e.g. by a band gap circuit. At the output of the regulator 8, it outputs a control potential 16 for controlling the gate potential of the main transistor T2. In particular, it varies the control potential 16 so that the transistor T2 increases the voltage VCC at the output 10 when the reference voltage at the input 14 is higher than the voltage fed back to the input 12 and, conversely, when the reference voltage is lower than the voltage fed back, so as to regulate the voltage VCC at the output 10 to a desired voltage.

Between the gate terminal of the main transistor T2 and the gate terminal of the bypass transistor T1 is connected the resistor R1, so that at a first terminal of the latter is present the control potential 16 of the main transistor T2 and the second terminal 18 of same is connected to the gate of the bypass transistor. For controlling the gate potential of the bypass transistor T1, the connecting circuit 4 has the voltage-controlled current source 6, which is connected between the second terminal 18 of the resistor R1 and the reference potential 20. Furthermore, the connecting circuit 4 includes a differential amplifier 22, which controls the current source 6. A voltage difference at the input of the differential amplifier 22 is formed from a reference potential VREF at a first input of the differential amplifier 22, on the one hand, and a potential at a second input of the differential amplifier 22 derived from the supply potential VBAT via a voltage divider 24 comprised of two resistors 24*a* and 24*b*, on the other hand. As will be described later with reference to FIG. 2, the reference potential VREF can e.g. depend on the output potential VCC. Furthermore, instead of a signal derived from VBAT, VBAT can also serve directly as an input signal for the differential amplifier 22, or another signal derived from another voltage source from which can also be derived VBAT, which is, however, different from DCDC. The subdivision into differential amplifier 22 and controllable current source 6 in FIG. 1 serves, furthermore, for explanation purposes and should therefore not be understood in a restrictive way. An implementation for assuming the same function as the connecting circuit 4 can depart from this subdivision, as is also explained with reference to FIG. 2.

In the above embodiment, the main transistor T2 is formed as a longitudinal transistor, which is connected between the intermediate potential VDCDC and the output potential VCC. The intermediate potential VDCDC results, as mentioned above, e.g. from a low setting of the supply potential, e.g. by means of a buck-converter. The bypass transistor T1 is connected between the supply potential VBAT and the output potential VCC. Through feeding back a fraction of the output potential VCC via the voltage divider 2 to the regulator 8, the main control potential 16 of the main transistor T2 is set so that VCC adopts the desired value. Of course, this works only until a sufficiently high intermediate potential VDCDC is present, which, in turn, assumes a sufficiently high VBAT from which VDCDC is derived, or a sufficiently high output voltage of the voltage source from which VBAT and VDCDC are derived. The continuous connection of the bypass transistor T1 is achieved by generating its control potential 18 via a voltage drop at the resistor R1 from the main control potential 16 that is present at the transistor T2. The voltage drop across the resistor R1 is controlled via the current created by the voltage-controlled current source 6 and flowing through the resistor R1. The larger the voltage difference at the input of the differential amplifier 22, the higher the current flowing through the resistor R1. Thus, at accordingly high battery voltages VBAT, current flows through the resistor R1 and the control potential 18 of the bypass transistor T1 is lowered with respect to that of transistor T2, whereby it is inactive. If the battery voltage VBAT drops toward VREF, the differential amplifier 22 causes a reduction of the current through the resistor R1, whereby the control potential 18 of the bypass transistor T1 is continuously brought closer to the control potential 16 of the main transistor T2. If the battery voltage VBAT and, in particular, the fraction of the battery voltage VBAT defined by the voltage divider 24 drops below a value VREF, the resistor R1 is finally de-energized and, hence, both transistors (T1 and T2) operate in parallel with the same control potential 16.

With respect to further embodiments, various embodiments of the transistors used can be contemplated. Thus, e.g. bipolar transistors can be used. In particular, the use of CMOS transistors can be contemplated. Depending on the embodiment, emitter or source terminals then correspond to the transistor source terminals, collector or drain terminals to the transistor sink terminals, and base or gate terminals to the transistor control terminals. This also applies to the transistors in the following embodiment of FIG. 2.

Figure 2:
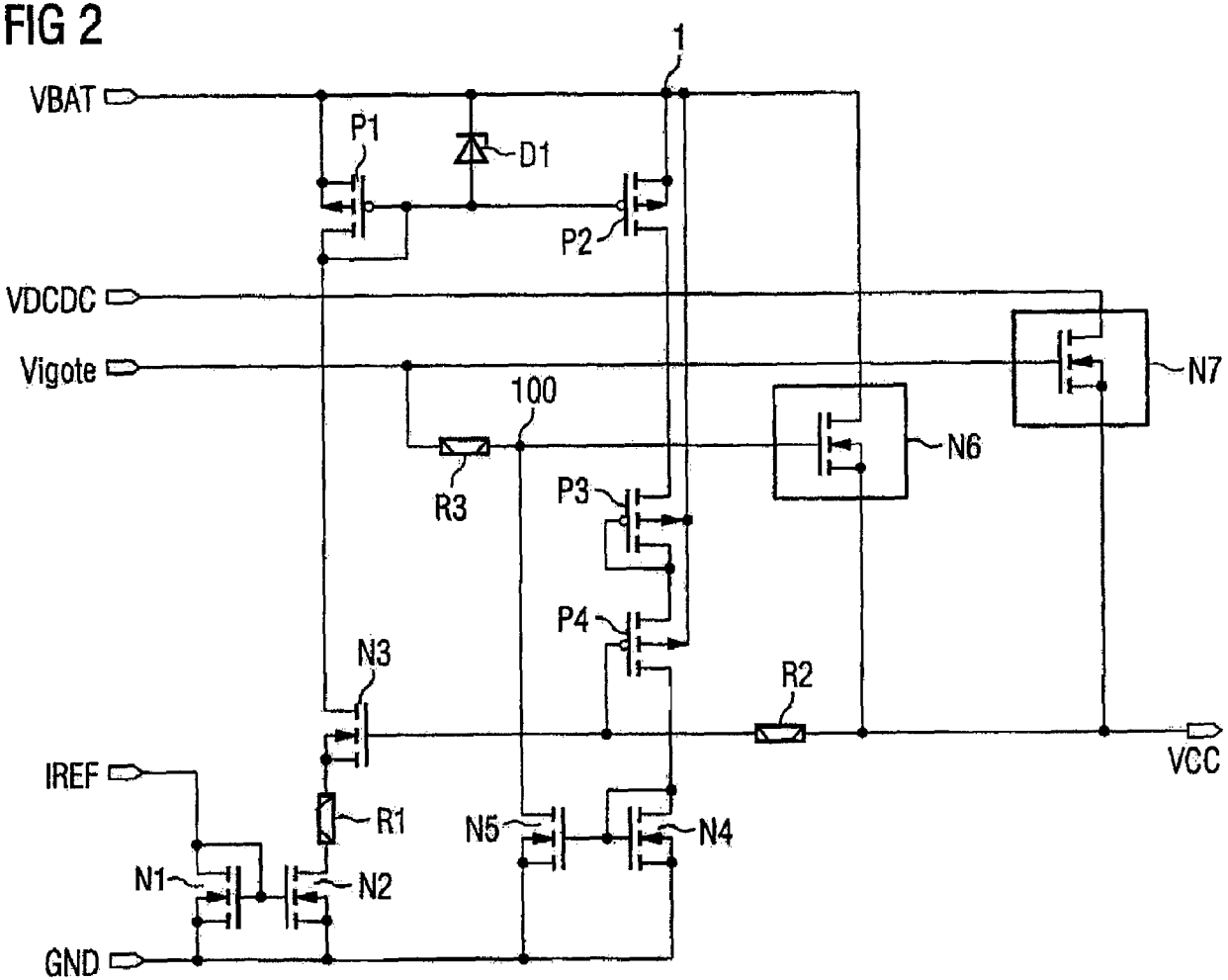
FIG. 2 is a circuit diagram of a circuit part, which represents one example of a detailed implementation of the voltage regulation circuit of FIG. 1, except for the feedback loop, which includes the regulator and the voltage divider.

FIG. 2 shows a circuit diagram of a circuit part representing an embodiment of a detailed implementation of a voltage regulator according to FIG. 1, except the feedback loop including the regulator and the voltage divider. An input current IREF is coupled in via a current mirror with cascode consisting of a current mirror with NMOS transistors N1, N2 and a counter-coupled NMOS transistor N3. The source terminals of both NMOS transistors N1, N2 are both at one and the same ground potential GND. The gate terminals of the transistors N1 and N2 are also at one and the same potential or are connected to each other and are in addition connected to the drain terminal of the transistor N1. The drain terminal of the NMOS transistor N2 is connected via a resistor R1 to the source terminal of the NMOS transistor N3 the drain terminal of which is, in turn, connected to the drain and gate terminal of a PMOS transistor P1 belonging to a current mirror comprised of two PMOS transistors P1, P2. The source terminals of the PMOS transistors P1 and P2 are each at the battery potential VBAT. Between the gate terminals connected to each other of P1 and P2 and the battery potential VBAT, a Zener diode D1 is connected for protection purposes. The drain terminal of the PMOS transistor P2 is furthermore coupled to the source terminal of a further PMOS transistor P3 the drain and gate terminals of which are at the same potential or are connected to each other and to the source terminal of a PMOS transistor P4 the gate terminal of which is connected to that of the NMOS transistor N3 and via the resistor R2 to the output VCC for the output potential VCC to be regulated. The drain terminal of the transistor P4 is, in turn, connected to the drain and gate terminal of an NMOS transistor N4 belonging to a third current mirror comprised of two NMOS transistors N4, N5. The two source terminals of N4, N5 are each at the ground potential GND. The drain terminal of the transistor N5 is connected via a node 10 to the gate terminal of an NMOS bypass transistor N6 the source of which is at the output potential VCC and the drain of which at the battery potential VBAT. Between the node 10 and a terminal VGATE is connected a resistor R3. The control potential VGATE constitutes the gate potential of an NMOS main transistor N7 the source of which is at the output potential VCC and the drain of which at an intermediate potential VDCDC.

In the circuit of FIG. 2 the battery potential VBAT is present at each of the bulk terminals of the PMOS transistors P#, while in the NMOS transistors N# the bulk terminal is connected to the source. Other configurations are also possible.

The two NMOS transistors N6 and N7 are the bypass and main transistors, which generate the output voltage VCC. The decrease of the gate potential of the bypass transistor N6 occurs due to the current that is drawn across the resistor R3 by the NMOS transistor N5. The current of N5 is generated by repeated mirroring of the input current IREF via the current mirrors N1/N2, P1/P2 and N4/N5. The two PMOS transistors P3 and P4 generate at the source of P3 or the drain of P2 a potential that is two gate-source voltages above the desired output voltage VCC. As long as VBAT is so high that the drain-source voltage of P2 is higher than the saturation voltage, a constant current flows through P2. If the drain-source voltage of P2 falls below the saturation voltage, the outmirrored current is continuously reduced by the resistor R3, whereby the gate potential of the bypass transistor N6 is raised. If the battery voltage VBAT drops below a value that is two gate-source voltages above the desired output voltage VCC, the resistor R3 is de-energized and the gate potential of the bypass transistor N6 is therefore at the same control potential VGATE as the gate of the main transistor N7.

In the embodiment according to FIG. 2, the connection of the bypass transistor N6 into the main regulation loop (not shown in FIG. 2) hence occurs continuously, whereby discontinuities in the regulation loop and thus in the output voltage VCC are avoided. With this exemplary embodiment, a glitch-free, stable, regulated output voltage VCC can be supplied for supply potentials or battery voltages above a voltage that is two gate-source voltages above the desired output voltage VCC.

The above embodiments of a voltage regulator thus allow for the connection of the bypass transistor so that no or less glitches can be seen at the output voltage VCC in the connection procedure. This is achieved by generating the control potential of the bypass transistor from the main control potential via the voltage drop at a resistor. The resistor is connected, at a first terminal, to the control potential of the main transistor and, at a second terminal, to the control line of the bypass transistor. At high battery voltages, current flows through the resistor, and the control potential of the bypass transistor is reduced with respect to the main control potential, whereby it is inactive. If the battery voltage decreases, the current through the resistor is also reduced and the control potential of the bypass transistor is brought closer to the control potential of the main transistor. From a pre-defined minimum battery voltage on, the resistor is de-energized and both transistors thus operate in parallel with the same control potential.

It should be pointed out that, with respect to further embodiments, the control of the bypass control potential can also be realized otherwise. Thus, e.g. an implementation of the control circuit can be contemplated by means of a constant-current source and a controllable or connectable resistor, or a mixture of both scenarios with both a variable current flow and a variable resistor. For bringing about the controllable resistor, e.g. the use of transistors wired accordingly can be contemplated, such as e.g. a MOS transistor operated in the triode domain and which is connected by its source-drain path between the two control inputs of the bypass and main transistors. Reactive elements in the control circuit could also be used for controlling the bypass control potential, in order to allow for continuous connection of the bypass transistor.

Furthermore, a quasi-continuous connection of the bypass transistor can be contemplated, the bypass control potential being adapted to the main control potential step by step as a function of VBAT with pre-defined step sizes.

In particular, the attention is drawn on the fact that according to the circumstances, the scheme according to one of the embodiments can also be implemented in software. The implementation can occur on a digital storage medium, in particular a floppy disk or CD with electronically readable control signals, which can cooperate with a programmable computer system and/or microcontroller so that the corresponding method can be carried out. Thus, a computer program product may have a program code stored on a machine-readable carrier for carrying out the method according to an embodiment when the computer program product is executed on a computer and/or microcontroller. In other words, an embodiment can thus be realized as a computer program with a program code for carrying out the method when the computer program is executed on a computer and/or a microcontroller.

While this invention has been described in terms of several embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations and equivalents as fall within the true spirit and scope of the present invention.

What is claimed is:

1. An apparatus for providing a regulated voltage at a voltage output, comprising:

a main transistor, which is connected between an intermediate potential and the voltage output;

a bypass transistor, which is connected between a supply potential and the voltage output, the intermediate potential being lower than the supply potential and the intermediate potential and the supply potential being derived from a common voltage source;

a regulation circuit for applying a main control potential to the main transistor, in order to regulate a voltage at the voltage output to a desired voltage; and a control circuit for generating a bypass control potential as a function of the supply potential and the main control potential, and for applying the bypass control potential to the bypass transistor.

2. The apparatus according to claim 1, wherein the control circuit comprises an impedance element, which comprises a first terminal and a second terminal, the first terminal being connected to a control terminal of the main transistor at which is present the main control potential, and the second terminal being connected to a control terminal of the bypass transistor.

3. The apparatus according to claim 2, wherein the impedance element is a resistive element.

4. The apparatus according to claim 2, wherein the control circuit comprises a current-supply controlled as a function of the supply potential, which is formed so as to supply through the impedance element a current flow depending on the supply potential.

5. The apparatus according to claim 2, wherein the control circuit comprises a current-supply controlled as a function of the supply potential, which is connected between the second terminal of the impedance element and a reference potential, in order to create through the impedance element a current flow as a function of the supply potential.

6. The apparatus according to claim 2, wherein the impedance element is a resistive element with an adjustable resistance value, and the control circuit comprises a current-supply for supplying a constant current flow through the resistive element with adjustable resistance value and is formed so as to change the resistance value of the resistive element as a function of the supply potential.

7. The apparatus according to claim 1, wherein the control circuit is formed such that the generation of the bypass control potential occurs in a way continuously changing as a function of the supply potential.

8. The apparatus according to claim 1, wherein the control circuit comprises a current-supply controlled as a function of the supply potential, which comprises a first current mirror and a second current mirror for mirroring a launched current, which are connected so that a sink terminal of a first transistor of the first current mirror is connected to the source terminal of a second transistor the sink and control terminals of which are connected, and which is connected to the source terminal of a third transistor the control terminal of which is coupled to the voltage output and the sink terminal of which is connected to the sink and control terminals of a fourth transistor belonging to the second current mirror.

9. A method for providing a regulated voltage at a voltage output by means of a main transistor, which is connected between an intermediate potential and the voltage output, and a bypass transistor, which is connected between a supply potential and the voltage output, the intermediate potential being lower than the supply potential and the intermediate potential and the supply potential being derived from a common voltage source, the method comprising:

applying a main control potential to the main transistor, in order to regulate a voltage at the voltage output to a desired voltage;

generating a bypass control potential as a function of the supply potential and the main control potential; and applying the bypass control potential to the bypass transistor.

10. A computer program with a program code for performing, when the computer program is executed on a computer and/or a microcontroller, a method for providing a regulated voltage at a voltage output by means of a main transistor, which is connected between an intermediate potential and the voltage output, and a bypass transistor, which is connected between a supply potential and the voltage output, the intermediate potential being lower than the supply potential and the intermediate potential and the supply potential being derived from a common voltage source, the method comprising:

applying a main control potential to the main transistor, in order to regulate a voltage at the voltage output to a desired voltage;

generating a bypass control potential as a function of the supply potential and the main control potential; and applying the bypass control potential to the bypass transistor.

11. An apparatus for providing a regulated voltage at a voltage output, comprising:

a first transistor connected between a first potential and the voltage output;

a second transistor connected between a second potential and the voltage output, wherein the first potential is lower than the second potential;

a regulation circuit generating a control signal fed to the first transistor, in order to regulate the voltage output; and a control circuit controlling the second transistor as a function of the second potential and the control signal.

12. The apparatus according to claim 11, wherein the first and second potential are derived from a common voltage source.

13. The apparatus according to claim 11, wherein the control circuit comprises an impedance element, which comprises a first terminal and a second terminal, the first terminal being connected to a control terminal of the first transistor, and the second terminal being connected to a control terminal of the second transistor.

14. The apparatus according to claim 13, wherein the impedance element is a resistive element.

15. The apparatus according to claim 13, wherein the control circuit generates a current as a function of the second potential.

16. The apparatus according to claim 13, wherein the control circuit comprises a current-supply controlled as a function of the second potential, which is connected between the second terminal of the impedance element and a reference potential, in order to create through the impedance element a current flow as a function of the supply potential.

17. The apparatus according to claim 13, wherein the impedance element is a resistive element with an adjustable resistance value, and the control circuit comprises a current-supply for supplying a constant current flow through the resistive element with adjustable resistance value and is formed so as to change the resistance value of the resistive element as a function of the second potential.

18. The apparatus according to claim 11, wherein the control circuit is formed such that the generation of a control potential at the second transistor occurs in a way continuously changing as a function of the second potential.

19. The apparatus according to claim 11, wherein the control circuit comprises a current-supply controlled as a function of the second potential, which comprises a first current mirror and a second current mirror for mirroring a current, which are connected so that a sink terminal of a third transistor of the first current mirror is connected to the source terminal of a fourth transistor, the sink and control terminals of which are connected, and which is connected to the source terminal of a fifth transistor, the control terminal of which is coupled to the voltage output and the sink terminal of which is connected to the sink and control terminals of a sixth transistor belonging to the second current mirror.

* * * * *